US008469701B2

(12) United States Patent
Quinn et al.

(10) Patent No.: US 8,469,701 B2
(45) Date of Patent: Jun. 25, 2013

(54) CANDLE HOLDER AND EXTINGUISHER

(76) Inventors: Yolande Quinn, Duncanville, TX (US); Tara Franklin, Desoto, TX (US)

( * ) Notice: Subject to any disclaimer, the term of this patent is extended or adjusted under 35 U.S.C. 154(b) by 448 days.

(21) Appl. No.: 12/284,645

(22) Filed: Sep. 24, 2008

(65) Prior Publication Data

US 2010/0075265 A1 Mar. 25, 2010

(51) Int. Cl.
*F21V 35/00* (2006.01)

(52) U.S. Cl.
USPC ..... 431/289; 431/33; 431/34; 431/35; 431/291; 431/298; 431/146; 431/152; 431/144; 431/145; 215/235; 215/236; 215/237

(58) Field of Classification Search
USPC ..... 431/289, 33, 34, 35, 291, 298, 146, 431/152, 144, 145; 215/235, 236, 237
See application file for complete search history.

(56) References Cited

U.S. PATENT DOCUMENTS

| | | | | |
|---|---|---|---|---|
| 4,237,097 | A * | 12/1980 | McDuffie | 422/126 |
| 6,572,365 | B1 * | 6/2003 | Byxbe | 431/33 |
| 7,198,484 | B2 * | 4/2007 | Hart et al. | 431/33 |
| 2007/0072140 | A1 * | 3/2007 | Almodovar | 431/289 |
| 2007/0128561 | A1 * | 6/2007 | Hart | 431/33 |

* cited by examiner

*Primary Examiner* — Avinash Savani
(74) *Attorney, Agent, or Firm* — Kiana Yvette Williams

(57) ABSTRACT

Apparatus and method for extinguishing a candle by selecting a predetermined time for which the candle will burn and as a predetermined time is reached an exterior wall rises, engulfs, and covers the candle and flame. Upon coverage of the candle and flame the candle is extinguished, in a safe, secure, protective manner. Upon reaching a final predetermined time of the preset time selected by the user for the candle to burn an alarm sounds notifying the user the apparatus is closing.

20 Claims, 2 Drawing Sheets

*FIG. 1*

CANDLE HOLDER AND EXTINGUISHER

BACKGROUND OF THE INVENTION

1. Field of the Invention

The present invention most directly relates to safety devices for candles. This invention focuses on increasing the safety of candles by safely extinguishing a candle and preventing the danger of fires. More specifically, the invention is an apparatus for automatically extinguishing a candle in a safe environment.

2. Description of the Related Art

Candles have been used for lighting and decorations for centuries. Where candles originally began as a necessity, a way to provide lighting, it now is used mainly as a decorative item. Today candles are typically used to create an ambience, of soft lighting and dispensing a fragrant scent. Use of candles ranges from calming peripheral senses, kindling romance, stress relief, healing, and as simplistic as a household air freshening tool.

The use of candles has become popular and prominent across the world, however while candles provide such a beneficial use, that use has been followed by a long existing hazard. Since the early use of candles, the hazard that has followed is commonly fires. The National Fire Protection Association reported that half of the home candle fires occurred by the candle being placed too close to a combustible item, 18% was from unattended or abandoned candles, which falling asleep was a factor in 12% of the fire cases. The fires caused by candles may result in great amounts of property damage and possibly deaths as well.

One of the more common causes of the candle fire hazard is the type of wick used in the candle. The length of a candle wick directly relates to the manner in which the flame will burn. Longer candle wicks for a taller flame, those tall flames will normally burn in an irregular pattern. These irregular patterns create a dangerous propensity for fires. The dangers as it relates to candle wicks, is the possibility of overheating. It is this unpredictable rise and variation in temperature which may cause a candle container to crack. This cracking of the candle container while it is still burning has been a significant concern as well as a fire hazard. In addition to cracking, overly long wicks may spark off and float in the air. This increases the risk of such sparks landing on flammable items, increasing the likelihood of fires.

The temperature spikes which occur are most often related to the length of the candle wick. When a candle wick flares out, the fire that ensues may burn erratically. Such erratic behavior can cause the flame to burn uncontrollably causing a fire. Extended candle exposure to temperature below 40 degrees Fahrenheit can cause candle wax to crack, which is an unsafe condition. Extended candle exposure to temperatures above 80 degrees Fahrenheit can make the wax soften and it will begin to lose its shape. Extended candle exposure to temperatures well above 80 degrees Fahrenheit causes the candle flame to burn too hot, which creates the erratic flame and causes overheating of the candle and extreme chance of a fire. Increased temperatures in wax causes glass containers holding the wax to crack or even explode. This normally occurs when the wax is too low and the candle continues to burn. The best solution to this problem is to automatically extinguish the candle before any critical temperatures are reached.

Another common cause of candle fires occurs as a result of human error. The most common form of human error is forgetfulness. When a candle is left burning and is unattended, for a period of time longer than deliberately anticipated, the chances of a fire is heightened. Almost 60% of candle fires result from unattended candles. The candle may be unattended because the user has left the location where the candle was burning without extinguishing the fire.

This human error factor which causes potential fires may occur when placing the candle in areas of high drafts, from a window, a vent or an air conditioning may cause the candle to burn unevenly, this also speeds up the burn time. This may also increase the likelihood of fires.

A fire hazard is also created with the placement of combustible items within an unsafe perimeter around the candle, such as curtains, paper, furniture, wood or even plastic. Leaving these materials within the unsafe perimeter of the candle is another source of candle based fires.

These hazards caused by candle use are acknowledged across the world and many steps have been taken to provide products to the public which will decrease the likelihood of fires. Many devices and apparatuses which currently exist are dedicated to the sole purpose of providing methods to extinguish candles in a safe environment in order to reduce the risk of fires. The most closely related prior art relates to attempts to alleviate the risk of fire, by extinguishing candle flames after a predetermined amount of time by utilizing a collapsible hinge. This hinge is fixed to the lid of the container. The hinge is magnetic and it holds the lid open and when the lid is released and the container containing the candle is closed. This process eliminates the air flow and extinguishes the candle.

Other devices which attempt to achieve this goal include U.S. Pat. Nos. 6,572,365, 7,198,484, 7,226,284, 6,695,511, 6,379,242, 7,223,166, 6,494,708, D496,475, D511,985, 4,787,017, 7,067,772. However, the prior art does not adequately satisfy the problem of preventing fire hazards and arguably does not provide an aesthetically pleasing and useful design.

Therefore, it is useful and advantageous to provide a device and method of extinguishing a candle flame that will not only decrease the likelihood of fires, but also provide and aesthetically pleasing design for various sizes and shapes of candles, such that it will entice more candle users to use a fire hazard conscious device.

OBJECTIVE AND SUMMARY OF THE INVENTION

The present invention provides method and device for safely extinguishing candles, decreasing the risk of fires.

It is an objective of the present invention to reduce the risk of fires resulting from candle use.

It is an objective of the present invention to provide an effective method of extinguishing a candle and/or the flame on a candle, regardless of the shape or size.

It is an objective of the present invention to provide a temperature controlled environment to prevent a resulting fire due to candle overheating.

It is an objective of the present invention to provide a method and device for extinguishing a candle in an aesthetically pleasing package, allowing individuals to use candles in a safe environment.

It is an objective of the present invention to empower candle users by allowing the candle to be set to an allotted burning time.

It is an objective of the present invention to provide and method of smothering a candle flame after the lapse of a specific amount of time.

It is an objective of the present invention to provide a device which will aide in decreasing the percentage of fires in homes caused by burning candles.

Other objectives will become apparent as embodiments of the invention are described.

In an embodiment, the candle holder and extinguisher, contains a platform surface receptacle with an area capable of receiving a candle. This platform surface receptacle area (that platform area can be a ceramic plate) contains a plate made out of fireproof material, such as a ceramic material. The fireproof plate sits upon the platform surface receptacle area and serves as a platform on which the candle is housed. The receptacle also has at least one movable perimeter walls, which form an enclosure around area which the candle is housed. This is the fireproof area which is capable of receiving the candle.

An embodiment also provides a temperature controlled environment, where the base member is linked to a temperature monitor or sensor, which determines or senses the temperature of the heat given off by the candle. The temperature monitor or sensor senses the heat released by the candle. The monitor or sensor may also sense the temperature of all or part of the candle holder. When the heat increases to a predetermined temperature (e.g. a high risk or dangerous temperature), such as a temperature which effectuates and promotes a high probability of fires. The temperature sensor or monitor causes the perimeter walls to close, thereby extinguishing the candle. The triggering of the perimeter walls is automatic, and the walls begin to move towards the closure position, or may close together at once.

An embodiment also includes a timing device, which may activate the perimeter walls. As the timing device counts to a predetermined time (e.g. an expiration time) the perimeter walls began to move towards a closure position. Once the expiration time is reached on the timing device, the perimeter wall(s) have enclosed the area housing the candle. Once the perimeter wall has fully enclosed the receptacle area, the closure of the walls extinguishes the candle. Alternatively, the walls may remain open until reaching the predetermined time, upon which the perimeter walls may close all at once. The timing device provided within the base receptacle unit in an embodiment of the apparatus the timing device is digital with an LCD screen displaying the time. When the timing device reaches the predetermined time of the period and alarm sounds indicating the final predetermined time has been reached.

The device is powered by either a power supply such as an AC adapter or it may also run on battery power. These power sources supply power to operate the movement of the perimeter walls, the timing device, allowing it to count until reaching the final predetermined time and it also powers the alarm which sounds when the timing device reaches a predetermined time. Once the set time on the timing device has reached a predetermined time, the user of the device may reset the timing device to a predetermined amount of time. It should be understood by one of ordinary skill in the art that the invention may include a timing device which counts up to a predetermined time versus counting down from a predetermined time. It should also be understood by one of ordinary skill in the art while the power supply is described the perimeter walls may be spring loaded for actual movement.

BRIEF DESCRIPTION OF THE DRAWINGS

These and/or other aspects and utilities of the present invention will become apparent and more readily appreciated from the following description of the embodiments, taken in conjunction with the accompanying drawings, of which.

DETAILED DESCRIPTION OF EMBODIMENTS

Figure 1:
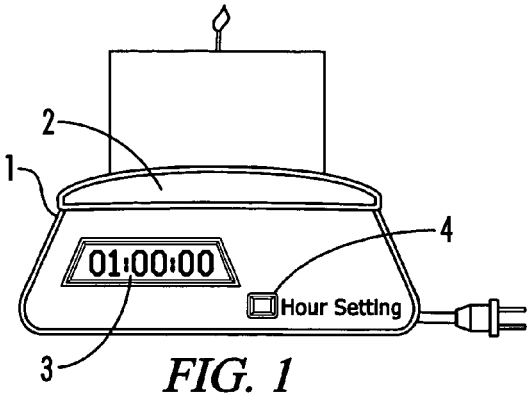
FIG. 1 is a diagram illustrating a conventional initial state of the device.

Reference will now be made in detail to embodiments of the invention, examples of which are illustrated in the accompanying drawings, wherein like reference numerals refer to the like elements throughout. The embodiments are described below in order to explain the present invention by referring to the figures.

FIG. 1 illustrates a simplified embodiment of the invention to demonstrate and describe various elements and operations thereof by way of a generalized implementation. Implementation details of certain embodiments of the invention are described below by way of more specific functional components.

As is illustrated in FIG. 1, the present invention is composed of a main base member 1, with a platform surface receptacle area 2 capable of receiving a candle (that platform area can be a ceramic plate). The candle or other object containing a candle may sit upon this platform surface receptacle area 2. The main base member 1 may be used as a storage space for at least one perimeter. At least one perimeter wall is movable, and has the capability of extending forward and retracting back into the main base member 1. The movement of the wall directly correlates to the timing device 3 coupled to the base member 1.

The base member and the platform surface receptacle area 2 capable of receiving a candle as illustrated in FIG. 1 are produced in a variety of different sizes and styles. FIG. 1, represents initial stage of the device prior to the user designating a preset or predetermined time 4 to begin the count on the timing device 3. At this time prior to the setting of the timing device 3, the perimeter walls are fully retracted. For example, as illustrated in FIG. 1, this figure represents the starting state of the device. The starting state of the device is with all side or enclosing walls retracted.

Figure 2:
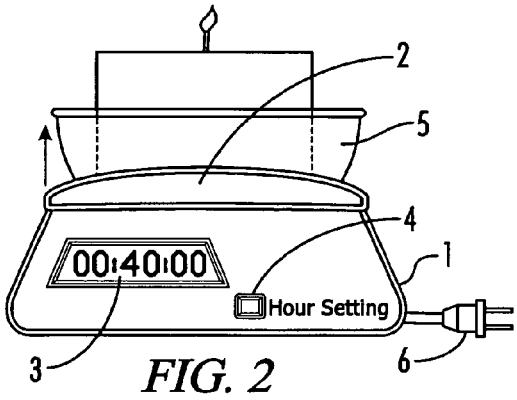
FIG. 2 is a diagram illustrating a conventional movement of the device once the timing device has been activated.

In FIG. 2, all elements or components serving the same purpose as elements or components, respectively, described above with reference to FIG. 1, in addition, in FIG. 2 the perimeter walls 5 began to move forward to enclose the area receiving the candle. The timing device 3 counts from the initial state of the timing device set by the user. In accordance with the time which has elapsed or accumulated the progression of the perimeter wall moves in correlation. As the timing device 3 counts toward its predetermined time the perimeter wall 5 slowly begin to close.

As illustrated in FIG. 2, an additional component connected to the base member 1 is the initiation button 4. This button 4 is used to designate the predetermined time and activate the timing device 3 which in turn activates the candle holder. The timing device 3 provided within the base member 1, in an embodiment of the present invention, the timing device is digital with an LCD screen displaying the time 3 as it counts down towards a predetermined time period.

FIG. 2, illustrates that the present invention is powered by a power supply connected to power supply cord 6 located within the base member 1. The power supply provides power to allow for the movement of the perimeter wall(s) 5. The power supply also generates power for the timing device 3 feature of the invention. It also powers the alarm and all electrical or mechanical components. Power may be supplied through a battery, allowing portability of the device. It may also be powered by use of an ac adapter, or other power sources known to one of ordinary skill in the art.

The base member 1 also serves as a storage unit and may be utilized to store different size perimeter retractable walls 5. The perimeter wall 5 is a solid structure made of fire proof material. The perimeter wall 5 may vary in length, height, and in the depth to which it retracts. The movement of the perimeter walls 5 is in correlation with the timing device 3. When the timing device 3 is set to begin using button 4, the timing device 3 counts to a predetermined time, the perimeter wall 5 slowly begins to close. The perimeter wall or walls 5 are responsive to the timing device 3, and timing device 3 may be set to a predetermined time by the user. The timing sequence on the timing device 3 may operate to count down to zero from a predetermined time by the user or may count up to a time predetermined by the user. The timing device 3 may either be analog, digital or mechanical. Optionally, as timing device 3 gets close to reaching a predetermined time, the perimeter walls began to move to enclose the entire area receiving the candle. Alternatively, the perimeter walls may only move once the timing device has elapsed or reached a predetermined time by the user. At the time of expiration or predetermined time reached, the perimeter walls have enclosed the platform. The encasing of the entire platform surface receptacle area 2 capable of receiving a candle extinguishes the candle.

Figure 3:
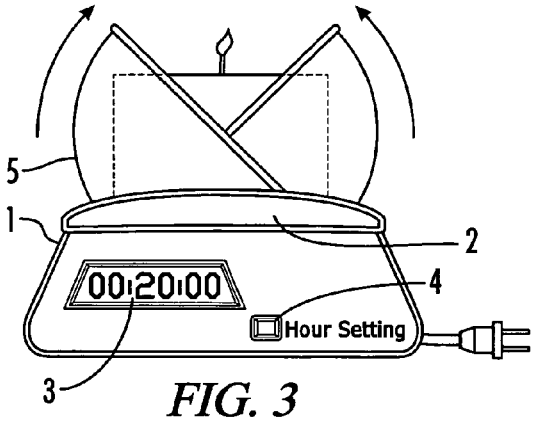
FIG. 3 is a diagram illustrating the movement of the perimeter walls as the timing device continues to move towards its predetermined time.

The speed in which the perimeter wall 5 moves varies according to the amount of time pre-designated by the user 4. The perimeter wall 5 encompasses the perimeter of the platform surface area containing the ceramic plate 2, also housing the candle but not limited to also the circumference of that area, depending on the shape of the base member 1. The perimeter wall 5 may be advanced in two portions as in FIG. 3; however it may be advanced forward in one portion or more than one portion. The motion of the advancement of the perimeter wall 5 is such that the two portions as shown in FIG. 3, advance upwards simultaneously until both portions meet and seal as in FIG. 4.

The timing device 3 of this device may be set in multiple intervals. The timing device 3 may consist of three two hour increment settings. For example the first setting can allow for a preset time limit until closure of two hours, the second can be for a preset time limit until closure of four (4) hours and the third can be for six (6) hours. The incremental setting depends on how long the user wishes the candle to burn. The timing device or timing device 3 on the device is not limited to only three incremental settings. The timing device 3 may also be set for any particular increment of time. The unit then counts down to zero 3. The timing mechanism is controlled by a button 4 pressed by the user which may add or decrease the predetermined time on the apparatus.

Figure 4:
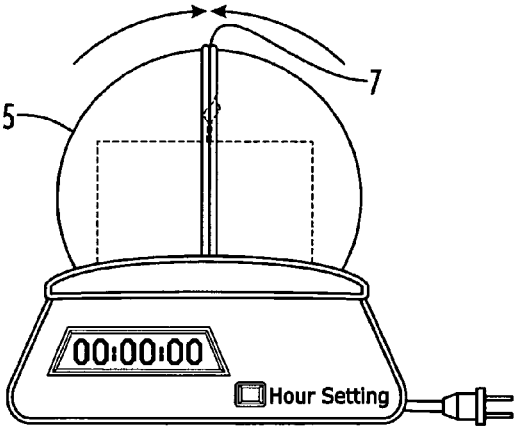
FIG. 4 is a diagram illustrating the state of the device and the location of the perimeter walls once the timing device reaches its predetermined period.
Figure 5:
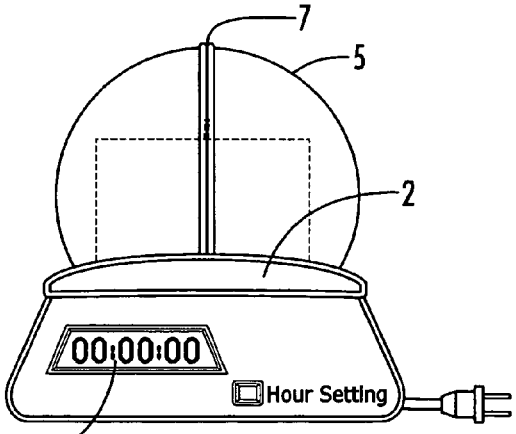
FIG. 5 is a diagram illustrating the movement of the perimeter walls after the timing device has reached its predetermined time and the flame has been extinguished.
Figure 6:
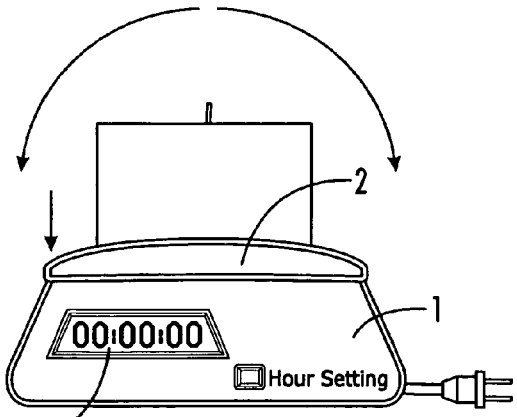
FIG. 6 is a diagram illustrating the final position of the perimeter walls once the timing device period has reached its predetermined time and the flame has been extinguished.

In FIG. 4, the perimeter wall 5 extends forward in motion until the perimeter wall 5 seals 7 and extinguishes the flame, as shown in FIG. 5. Once the sides meet and seal 7, it is held sealed for a predetermined period of time to extinguish the flame. The perimeter wall may retract automatically as shown in FIG. 6. In another embodiment of the invention the perimeter wall 5, once sealed 7 will only retract if manually set. The override button to manually reset the perimeter walls 5 may be set for any perimeter wall 5 to detract. The perimeter wall 5, itself is made of a fire proof material. The outer rim of the perimeter wall 5 may either be coated with a fire proof material such that flame and fire damage shall be limited or the perimeter wall 5 may be made entirely out of a fireproof material. The edge of the perimeter wall 5 may be coated with a fire proof material such that when sides meet, the contact between the materials may create an airtight or near airtight seal as illustrated in FIG. 4 and FIG. 5. This seal in FIG. 4 allows the candle to be extinguished as shown in FIG. 5, by eliminating the air flow to the ignited flame within the device. Once closed the candle is safely extinguished.

Another feature of the timing device 3 occurs in FIG. 5, the alarm. When the timing device 3 reaches the predetermined time period an alarm sounds indicating the predetermined time has been reached. The alarm is triggered when the timing device 3 reaches a predetermined time. The alarm sounds when the candle extinguisher has enclosed the entire surface area 7, and the perimeter walls 5 have met and sealed 7. Once the perimeter wall 5 has fully enclosed the platform surface receptacle area 2 capable of receiving a candle, the closure of the walls 7 extinguishes the candle.

FIG. 5 illustrates the sealing or closure position 7. This sealing or closure position 7 is reached once the timing device has reached a predetermined time. At this position at least one movable perimeter wall 5 has enclosed the platform surface receptacle area 2 capable of receiving a candle. Once this platform surface receptacle area 2 is enclosed 7 the oxygen flow is eliminated, which extinguishes the candle. This position may also be maintained to preserve an ascetically pleasing candle appearance via use of the sealing button.

In FIG. 6 once the candle is extinguished the perimeter walls 5 retract back into the initial position as illustrated in FIG. 1. FIG. 6 illustrates an exemplary configuration of the reset position of the invention. The user may reset or override at any time by setting the timing device 3 to a predetermined time. Once a predetermined time has been reach then the device resets and the perimeter walls 5 fully retract. Allowing the user to remove the candle or the ceramic plate 2 from the base member 1. The ceramic plate 2 which houses the candle is removable, such that it may be changed and in other embodiments a fixed fixture. It is also may be made of material other than a ceramic based material as well. This ceramic plate 2 has the capacity to withstand heat. The ceramic plate 2 which houses the candle is also removable, such that it may be changed and in other embodiments a fixed fixture. It is also may be made of material other than a ceramic based material as well. This plate 2 has the capacity to withstand heat.

In another embodiment of the invention, the ceramic plate 2 has a temperature sensor or monitor attached to detect the heat level of the burning candle. The sensor monitors the rise in the candle heat by measuring the heat released from the wax or from any container or object placed upon the ceramic plate 2. Once the heat sensor or monitor attached to the ceramic plate on the platform surface receptacle area 2 is activated, the perimeter wall 5 shall extend out and extinguish the flame. This closure position 7 is held in maintained for a time duration long enough to extinguish the candle. The temperature sensor or monitor may also be attached to the base member 1.

In the temperature sensor or monitor embodiment. The temperature sensor or monitor portion monitors the temperature of the heat from the candle to determine if it the candle is burning to hot. The temperature sensor or monitor detects the heat from the candle, the wax or the object which rests upon the ceramic plate 2. When heat temperature detected rises to a dangerous level then the temperature sensor is triggered and the perimeter walls 5 extend and seal 7 overriding any time previously set 4 on the timing device 3. The sealing of the perimeter walls 5 shall seal and hold 7 for a predetermined time to extinguishing the flame. The perimeter walls 5 may either retract automatically or require manual retraction. This segment allows for the use of contact temperature sensors or monitors and no contact temperature sensors or monitors to detect and determine the acceptable heat and duration of that heat before an override of the timing device begins and the perimeter walls 5 extend towards closure. This portion provides a possible remedy to the danger of a glass container exploding due to excessive heat given off by the candle and it remedies the possibility overheating of the device.

Figure 7:
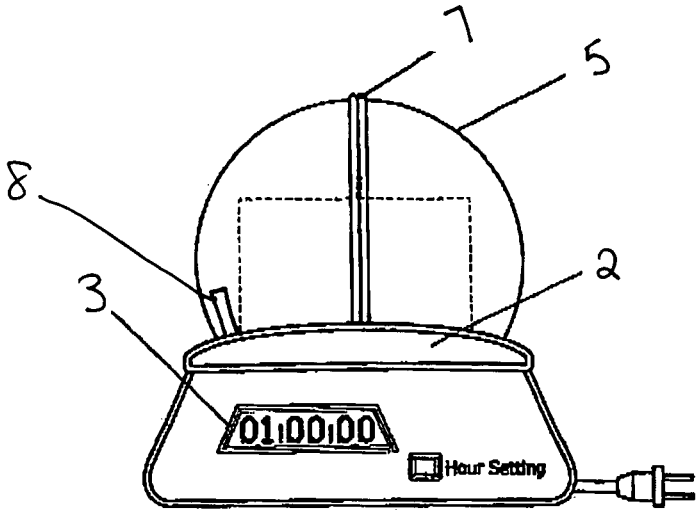
FIG. 7 is a diagram illustrating the device using a tube and a container allowing the fire retardant to flow through the device and extinguish the flame.

Another embodiment of this device allows at least one small single tube 8 to enter the device from the rear lower portion of the base 1 in FIG. 7. The tube 8 is hollow and serves as a conduit for the passage of a fire retardant. As in FIG. 7 this tube 8 is connected to a container, [not shown] within that container a fire retardant is held. Upon the sealing 7 of the device the fire retardant automatically sends out a blast of air through the tube into the enclosed device extinguishing the flame in FIG. 7.

In another embodiment, the timing device 3 also functions as a clock or chronometer, either digital or analog and displays the time in digital or analog form. Allowing the display of the date and time, as well as the remaining time left on the timing device count 3. The pressing of the button 4 allows the end user to switch between the clock, the timing device and the date for digital functions. For analog functions, the clock shall switch between the timing device and the current time. When the count on the timing device reaches zero the alarm sounds.

The present invention is intended to embrace all such alternative implementations, and others that will be apparent to the skilled artisan upon review of this disclosure. The descriptions above are intended to illustrate possible implementations of the present invention and are not restrictive. Many variations, modifications and alternatives will become apparent to the skilled artisan upon review of this disclosure. For example, components equivalent to those shown and described may be substituted therefore, elements and methods individually described may be combined, and elements described as discrete may be distributed across many components. The scope of the invention should therefore be determined not with reference to the description above, but with reference to the appended claims, along with their full range of equivalence.

What is claimed is:

1. An apparatus for extinguishing a candle comprising:

a domed receptacle, a candle received in said receptacle, the receptacle including at least one movable perimeter wall, which forms an enclosure around said area capable of receiving said candle; and a timing device connected to the receptacle perimeter walls, wherein upon reaching a final predetermined time of said timing device said at least one movable perimeter wall moves to enclose around said area receiving said candle, thereby extinguishing said candle and as said timing device is activated the progression of at least one the moveable perimeter wall moves concurrently with said timing device such that as time gradually expires a covered area receiving the candle gradually increases.

2. The apparatus for extinguishing a candle as recited in claim 1, wherein said timing device may be set to a predetermined time by a user.

3. The apparatus for extinguishing a candle as recited in claim 1, wherein the movement of said perimeter wall of said receptacle is powered by a power supply.

4. The apparatus for extinguishing a candle as recited in claim 1, wherein movement of said perimeter wall of said receptacle is actuated by at least one spring.

5. The apparatus for extinguishing a candle as recited in claim 1, wherein the timing device is digital.

6. The apparatus for extinguishing a candle as recited in claim 1, wherein the timing device is analog.

7. The apparatus for extinguishing a candle as recited in claim 1, wherein an alarm is triggered when the timing device reaches a predetermined time.

8. The apparatus for extinguishing a candle as recited in claim 1, wherein an alarm is triggered when a remaining time on the timing device reaches a predetermined amount of time before the timing device reaches its final predetermined amount of time.

9. The apparatus for extinguishing a candle as recited in claim 1, wherein upon complete enclosure by said at least one movable perimeter wall over said area for receiving said candle, all oxygen flow is eliminated when the timing device reaches a predetermined amount of time, thereby extinguishing said candle.

10. The apparatus for extinguishing a candle as recited in claim 1, wherein upon enclosure of said area, a fire retardant is released into said area to extinguish said candle.

11. The apparatus for extinguishing a candle as recited in claim 1, wherein said at least one movable perimeter wall closes slowly as said timing device reaches a predetermined amount of time, wherein when said timing device has reached its final predetermined time, said walls are completely closed around said area capable of receiving said candle.

12. The apparatus for extinguishing a candle as recited in claim 1, wherein the at least one perimeter wall is constructed of a fire-proof material.

13. The apparatus for extinguishing a candle as recited in claim 1, wherein said area for receiving said candle contains a removable plate that fits inside said area capable of receiving a candle.

14. The apparatus for extinguishing a candle as recited in claim 1, wherein said the area capable of receiving a candle said candle has a temperature sensor for monitoring the temperature of the candle.

15. The apparatus for extinguishing a candle as recited in claim 1, wherein said candle is extinguished when said sensor senses a predetermined temperature of said candle.

16. The apparatus for extinguishing a candle as recited in claim 1, wherein said the area capable of receiving a candle said candle has a temperature sensor for monitoring the temperature of said apparatus.

17. The apparatus for extinguishing a candle as recited in claim 1, wherein said candle is extinguished when a sensor senses a predetermined temperature of said apparatus.

18. The apparatus for extinguishing a candle as recited in claim 1, wherein an override button manually retracts the perimeter wall.

19. The apparatus for extinguishing a candle as recited in claim 1, wherein a sealing button manually seals the perimeter wall.

20. The apparatus for extinguishing a candle as recited in claim 1, wherein said timing device also functions as a chronometer, displaying date/time information.

* * * * *